US008851048B2

(12) United States Patent
Meistrick

(10) Patent No.: US 8,851,048 B2
(45) Date of Patent: Oct. 7, 2014

(54) DEDICATED ROCKER ARM ENGINE BRAKE

(75) Inventor: Zdenek S. Meistrick, West Granby, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 596 days.

(21) Appl. No.: 13/257,240

(22) PCT Filed: Apr. 27, 2009

(86) PCT No.: PCT/US2009/041814

§ 371 (c)(1), (2), (4) Date: Nov. 15, 2011

(87) PCT Pub. No.: WO2010/126479

PCT Pub. Date: Nov. 4, 2010

(65) Prior Publication Data

US 2012/0048232 A1 Mar. 1, 2012

(51) Int. Cl.

| | |
|---|---|
| ***F02D 13/04*** | (2006.01) |
| ***F01L 1/34*** | (2006.01) |
| ***F01L 1/08*** | (2006.01) |
| ***F01L 1/18*** | (2006.01) |
| *F01L 13/06* | (2006.01) |

(52) U.S. Cl.

CPC . *F01L 13/06* (2013.01); *F01L 1/08* (2013.01); *F01L 1/18* (2013.01); *F01L 13/065* (2013.01)

USPC ..... 123/321; 123/90.39

(58) Field of Classification Search

CPC ..... F01L 1/34; F01L 13/06; F01L 13/065; F01L 1/18

USPC ..... 123/321, 322, 90.11, 90.15, 90.36, 123/90.39, 90.41

See application file for complete search history.

(56) References Cited

U.S. PATENT DOCUMENTS

| | | | |
|---|---|---|---|
| 4,132,196 | A | 1/1979 | Wherry |
| 5,975,251 | A | 11/1999 | McCarthy |

(Continued)

FOREIGN PATENT DOCUMENTS

| | | |
|---|---|---|
| RU | 2145384 | 2/2000 |
| RU | 2301370 | 6/2007 |

*Primary Examiner* — Hieu T Vo

(74) *Attorney, Agent, or Firm* — Vedder Price PC

(57) ABSTRACT

A system for actuating an engine valve is disclosed. The system may include a rocker arm shaft (110) having a control fluid supply passage (112) and an exhaust rocker arm (500) pivotally mounted on the rocker arm shaft (110). A cam (210) for imparting main exhaust valve actuation to the exhaust rocker arm (500) may contact a cam roller associated with the exhaust rocker arm. A valve bridge (300) may be disposed between the exhaust rocker arm (500) and first and second engine valves (400, 450). A sliding pin (310) may be provided in the valve bridge (300), said sliding pin contacting the first engine valve (400). An engine braking rocker arm (100) may be pivotally mounted on the rocker arm shaft (110) adjacent to the exhaust rocker arm (500). The engine braking rocker arm may have a central opening, a hydraulic passage (102) connecting the central opening with a control valve (130), and a fluid passage (105) connecting the control valve with an actuator piston assembly (140). The actuator piston assembly may include an actuator piston (141) adapted to contact the sliding pin (310) during engine braking operation. A bushing (115) may be disposed between the engine braking rocker arm (100) and the rocker arm shaft (110). The bushing may have a port (118) which registers with the hydraulic passage (102). A cam (200) is provided for imparting engine braking actuation to the engine braking rocker arm (100). A plate (122) is fastened to a back end of the engine braking rocker arm (100), and a spring (124) biases the plate and the engine braking rocker arm (110) into contact with the cam (200).

13 Claims, 8 Drawing Sheets

(56) References Cited

U.S. PATENT DOCUMENTS

| | | | | |
|---|---|---|---|---|
| 6,000,374 | A | 12/1999 | Cosma | |
| 6,394,067 | B1 | 5/2002 | Usko et al. | |
| 7,823,553 | B2 * | 11/2010 | Meistrick | 123/90.39 |
| 8,230,831 | B2 * | 7/2012 | Persson et al. | 123/90.39 |
| 2008/0223325 | A1 | 9/2008 | Meistrick | |

* cited by examiner

DEDICATED ROCKER ARM ENGINE BRAKE

FIELD OF THE INVENTION

The present invention relates to systems and methods for actuating valves in internal combustion engines, and more specifically, actuating exhaust valves for engine braking.

BACKGROUND OF THE INVENTION

Internal combustion engines typically use either a mechanical, electrical, or hydro-mechanical valve actuation system to actuate the engine valves. These systems may include a combination of camshafts, rocker arms and push rods that are driven by the engine's crankshaft rotation. When a camshaft is used to actuate the engine valves, the timing of the valve actuation may be fixed by the size and location of the lobes on the camshaft.

For each 360 degree rotation of the camshaft, the engine completes a full cycle made up of four strokes (i.e., expansion, exhaust, intake, and compression). Both the intake and exhaust valves may be closed, and remain closed, during most of the expansion stroke wherein the piston is traveling away from the cylinder head (i.e., the volume between the cylinder head and the piston head is increasing). During positive power operation, fuel is burned during the expansion stroke and positive power is delivered by the engine. The expansion stroke ends at the bottom dead center point, at which time the piston reverses direction and the exhaust valve may be opened for a main exhaust event. A lobe on the camshaft may be synchronized to open the exhaust valve for the main exhaust event as the piston travels upward and forces combustion gases out of the cylinder.

The above-referenced main exhaust valve event is required for positive power operation of an internal combustion engine. Additional auxiliary valve events, while not required, may be desirable. For example, it may be desirable to actuate the exhaust valves for compression-release engine braking, bleeder engine braking, exhaust gas recirculation (EGR), brake gas recirculation (BGR), or other auxiliary valve events.

With respect to auxiliary valve events, flow control of exhaust gas through an internal combustion engine has been used in order to provide vehicle engine braking. Generally, engine braking systems may control the flow of exhaust gas to incorporate the principles of compression-release type braking, exhaust gas recirculation, exhaust pressure regulation, and/or bleeder type braking.

During compression-release type engine braking, the exhaust valves may be selectively opened to convert, at least temporarily, a power producing internal combustion engine into a power absorbing air compressor. As a piston travels upward during its compression stroke, the gases that are trapped in the cylinder may be compressed. The compressed gases may oppose the upward motion of the piston. As the piston approaches the top dead center (TDC) position, at least one exhaust valve may be opened to release the compressed gases in the cylinder to the exhaust manifold, preventing the energy stored in the compressed gases from being returned to the engine on the subsequent expansion down-stroke. In doing so, the engine may develop retarding power to help slow the vehicle down.

During bleeder type engine braking, in addition to, or in place of, the main exhaust valve event, which occurs during the exhaust stroke of the piston, the exhaust valve(s) may be held slightly open during the remaining three engine cycles (full-cycle bleeder brake) or during a portion of the remaining three engine cycles (partial-cycle bleeder brake). The bleeding of cylinder gases in and out of the cylinder may act to retard the engine. Usually, the initial opening of the braking valve(s) in a bleeder braking operation is in advance of the compression TDC (i.e., early valve actuation) and then lift is held constant for a period of time. As such, a bleeder type engine brake may require lower force to actuate the valve(s) due to early valve actuation, and generate less noise due to continuous bleeding instead of the rapid blow-down of a compression-release type brake.

Exhaust gas recirculation (EGR) systems may allow a portion of the exhaust gases to flow back into the engine cylinder during positive power operation. EGR may be used to reduce the amount of $NO_x$ created by the engine during positive power operations. An EGR system can also be used to control the pressure and temperature in the exhaust manifold and engine cylinder during engine braking cycles. Internal EGR systems recirculate exhaust gases back into the engine cylinder through an exhaust valve(s) and/or an intake valve(s). Embodiments of the present invention primarily concern internal EGR systems.

Brake gas recirculation (BGR) systems may allow a portion of the exhaust gases to flow back into the engine cylinder during engine braking operation. Recirculation of exhaust gases back into the engine cylinder during the intake stroke, for example, may increase the mass of gases in the cylinder that are available for compression-release braking. As a result, BGR may increase the braking effect realized from the braking event.

SUMMARY OF THE INVENTION

Responsive to the foregoing challenges, Applicant has developed an innovative system for actuating an engine exhaust valve for engine braking comprising: a rocker arm shaft (110) having a control fluid supply passage (112); an engine braking rocker arm (100) pivotally mounted on the rocker arm shaft (110), said engine braking rocker arm having a central opening disposed about the rocker arm shaft (110), a hydraulic passage (102) connecting the central opening with a control valve (130), and a fluid passage (105) connecting the control valve with an actuator piston assembly (140); a valve bridge (300) extending between first and second engine exhaust valves (400, 450); a sliding pin (310) provided in the valve bridge (300), said sliding pin contacting the first engine exhaust valve (400), wherein the actuator piston assembly (140) contacts the sliding pin (310); a cam (200) for imparting engine braking actuation to the engine braking rocker arm (100); and a spring (124) biasing the engine braking rocker arm (100) into contact with the cam (200).

Applicant has further developed an innovative system for actuating an engine valve comprising: a rocker arm shaft (110) having a control fluid supply passage (112); an exhaust rocker arm (500) pivotally mounted on the rocker arm shaft (110); a cam (210) for imparting main exhaust valve actuation to the exhaust rocker arm (500); a valve bridge (300) disposed between the exhaust rocker arm (500) and first and second engine valves (400, 450); a sliding pin (310) provided in the valve bridge (300), said sliding pin contacting the first engine valve (400); an engine braking rocker arm (100) pivotally mounted on the rocker arm shaft (110) adjacent to the exhaust rocker arm (500), said engine braking rocker arm having a central opening, a hydraulic passage (102) connecting the central opening with a control valve (130), and a fluid passage (105) connecting the control valve with an actuator piston assembly (140), wherein the actuator piston assembly includes an actuator piston (141) adapted to contact the sliding pin (310); a bushing (115) disposed between the engine braking rocker arm (100) and the rocker arm shaft (110), said bushing having a port (118) which registers with the hydraulic passage (102); a cam (200) for imparting engine braking actuation to the engine braking rocker arm (100); a plate (122) fastened to a back end of the engine braking rocker arm (100); and a spring (124) contacting the plate (122) and biasing the engine braking rocker arm (100) into contact with the cam (200).

It is to be understood that both the foregoing general description and the following detailed description are exemplary and explanatory only, and are not restrictive of the invention as claimed.

BRIEF DESCRIPTION OF THE DRAWINGS

In order to assist the understanding of this invention, reference will now be made to the appended drawings, in which like reference characters refer to like elements.

DETAILED DESCRIPTION OF EMBODIMENTS OF THE INVENTION

Figure 1:
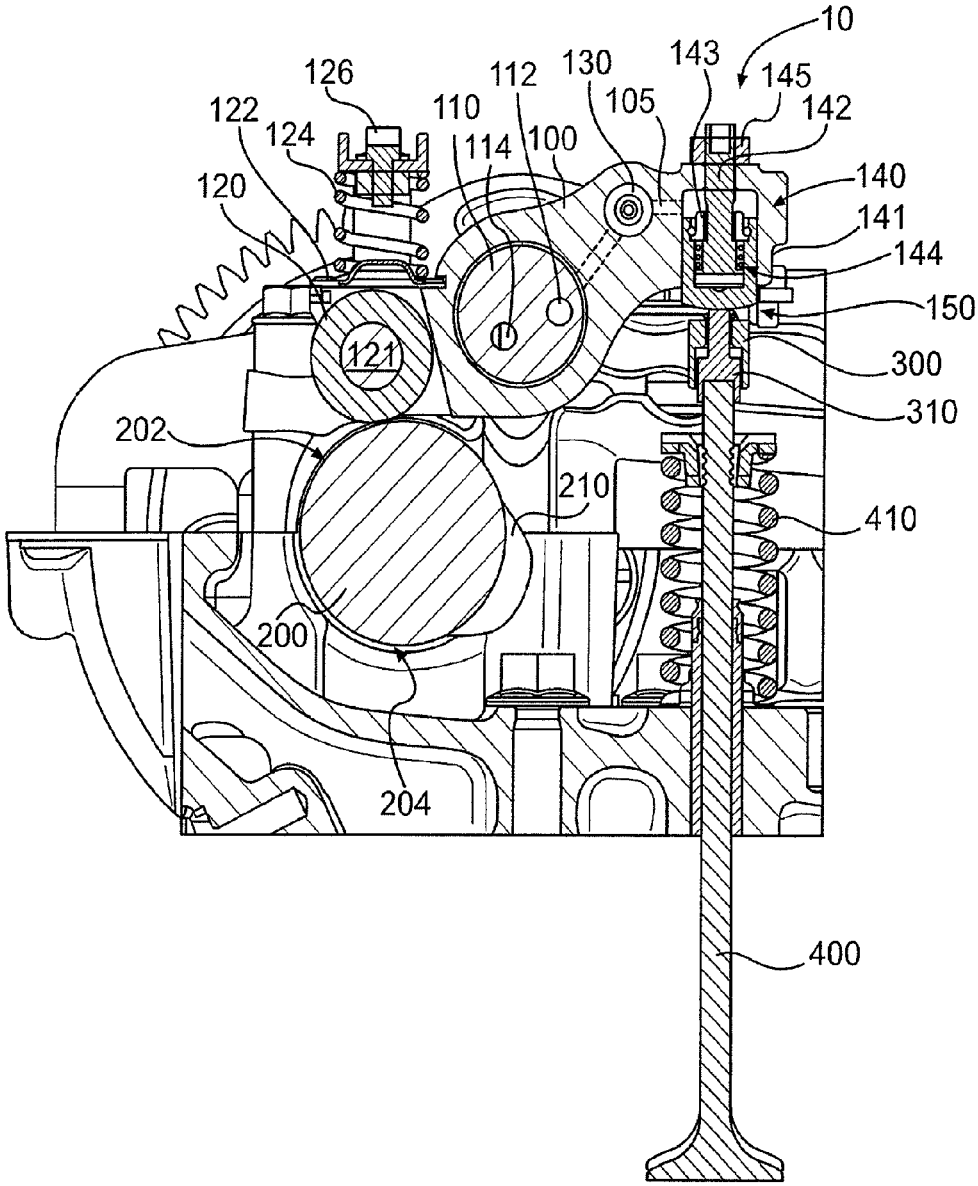
FIG. 1 is a side view in cross-section of a dedicated rocker arm 100 used for engine braking in accordance with an embodiment of the present invention when the brake is on and the cam roller 120 is on the upper base circle of the cam 200.

Reference will now be made in detail to a first embodiment of the present invention, an example of which is illustrated in the accompanying drawings. With reference to FIGS. 1-4 and 7-8, a system 10 for actuating engine valves, preferably an exhaust valve 400, is shown. The engine valves referenced constitute poppet-type valves 400 and 450 that are used to control communication between the combustion chambers (e.g., cylinders) in an engine and aspirating (e.g., intake and exhaust) manifolds. While the system 10 may be used potentially for intake valve actuation, the remainder of this description describes use of the system to actuate an exhaust valve 400 for engine braking. The system 10 includes a rocker arm shaft 110 on which at least two rocker arms are disposed. The rocker arms include an engine braking rocker arm 100 and an exhaust rocker arm 500 (shown in FIGS. 7 and 8). The rocker arms 100 and 500 may be pivoted about the rocker arm shaft 110 as a result of motion imparted to them by a camshaft 200 or some other motion imparting device, such as a push tube.

The exhaust rocker arm 500 is adapted to actuate exhaust valves 400 and 450, by contacting them through a valve bridge 300. The exhaust rocker arm 500 may be pivoted by rotation of a cam 210 having a main exhaust bump or lobe on it which contacts a cam roller provided on the exhaust rocker arm. The engine braking rocker arm 100 is adapted to selectively actuate one exhaust valve 400 by contacting a sliding pin 310 provided in the valve bridge 300, which in turn contacts the exhaust valve 400. The sliding pin 310 may have a shoulder provided at a mid-portion, which is adapted to engage a mating shoulder provided in a bore extending through the valve bridge 300. The exhaust valve 400 may be biased upward, into a closed position, towards the sliding pin 310 by one or more valve springs 410. The bias of the valve springs 410 may cause the shoulder on the sliding pin 310 to engage the mating shoulder within the valve bridge 300.

The engine braking rocker arm 100 may be pivoted by rotation of a cam 200 having an engine braking bump or lobe on it. The cam 200 may contact a cam roller 120 mounted on a shaft 121 provided at one end of the engine braking rocker arm 100. The cam 200 may have a lower base circle region 204 and an upper base circle region 202. The upper base circle region 202 of the cam 200 has a greater diametrical distance from the center of the cam as compared with lower base circle region 204 of the cam. Thus, the cam 200 may be adapted to provide compression-release, bleeder, or partial bleeder engine braking. Compression-release engine braking involves opening an exhaust valve (or an auxiliary engine valve) near the top dead center position for the engine piston on compression strokes (and/or exhaust strokes for two-cycle braking) for the piston. Bleeder engine braking involves opening an exhaust valve for the complete engine cycle; and partial bleeder engine braking involves opening an exhaust valve for a significant portion of the engine cycle.

Instead of, or in addition to the upper base circle region 202 for engine braking, the cam 200 may include one or more cam lobes such as for example, an exhaust gas recirculation (EGR) cam lobe (not shown) and/or a brake gas recirculation (BGR) cam lobe (not shown) adapted to impart one or more auxiliary valve actuation motions to the engine braking rocker arm 100. The optional EGR lobe may be used to provide an EGR event during a positive power mode of engine operation. The optional BGR lobe may be used to provide a BGR event during an engine braking mode of engine operation.

Figure 5:
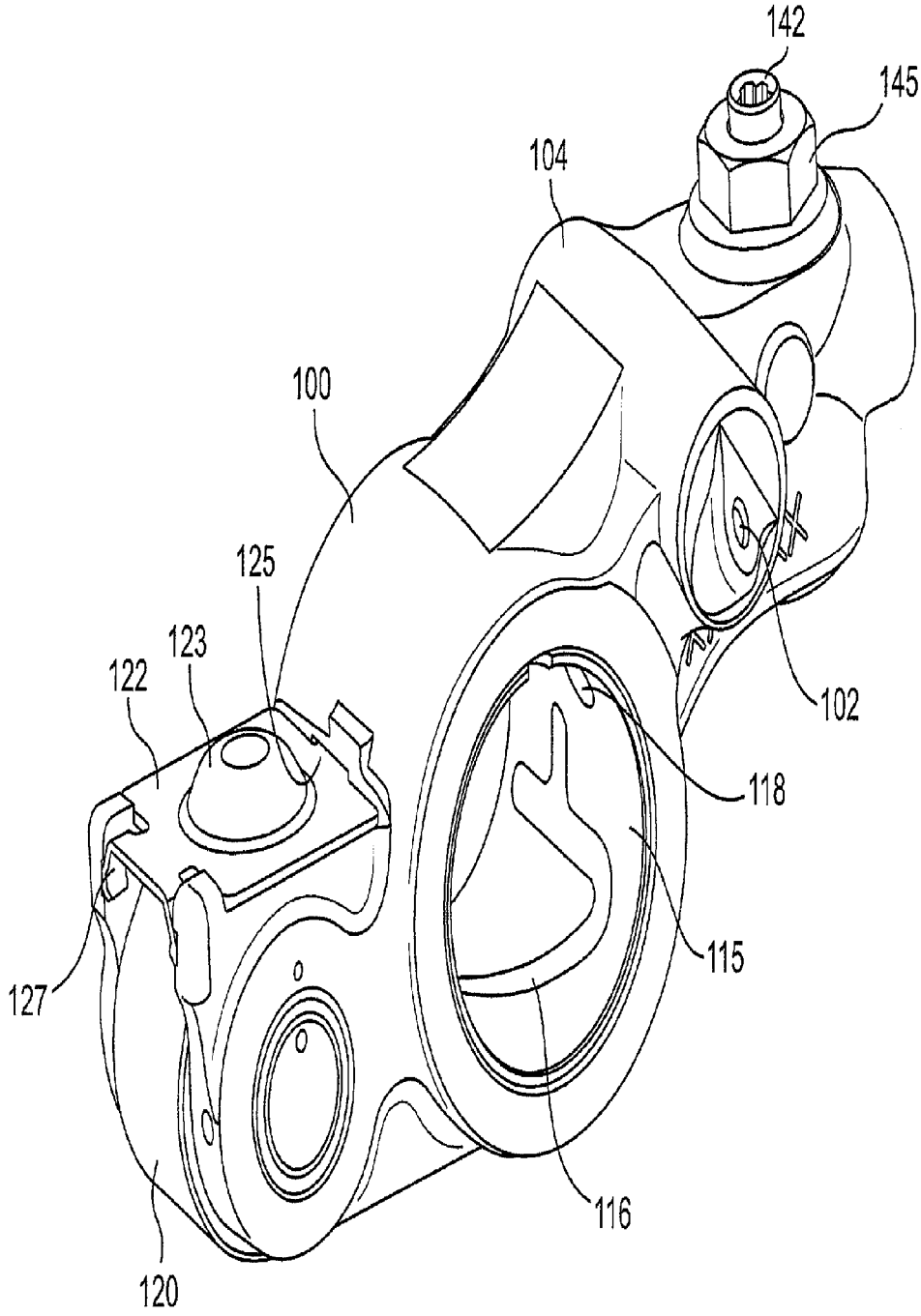
FIG. 5 is a side pictorial view of the rocker arm 100 shown in FIG. 1.

A coil spring 124 may engage a rear plate 122 fastened to the back end of the engine braking rocker arm 100 to bias the engine braking rocker arm towards the cam 200. The spring 124 may push against a bracket 126 or other fixed element. With reference to FIG. 5, the plate 122 may include a central raised portion 123 adapted to maintain the spring 124 in a central position relative to the plate. The plate 122 may further include a front tab 125 and side tabs 127 which engage mating slots provided on the engine braking rocker arm 100. The tabs 125 and 127 assist in maintaining the plate 122 in position, particularly during installation of the spring 124. The spring 124 may have sufficient force to maintain the engine braking rocker arm 100 in contact with the cam 200 throughout the rotation of the cam shaft.

With renewed reference to FIGS. 1-4, the rocker arm shaft 110 may include one or more internal passages for the delivery of hydraulic fluid, such as engine oil, to the rocker arms mounted thereon. Specifically, the rocker arm shaft 110 may include a constant fluid supply passage 114 and a control fluid supply passage 112. The constant fluid supply passage 114 may provide lubricating fluid to one or more of the rocker arms during engine operation. The control fluid supply passage 112 may provide hydraulic fluid to the engine braking rocker arm 100 and more particularly the actuator piston assembly 140 to control its use for engine braking valve actuation.

Figure 6:
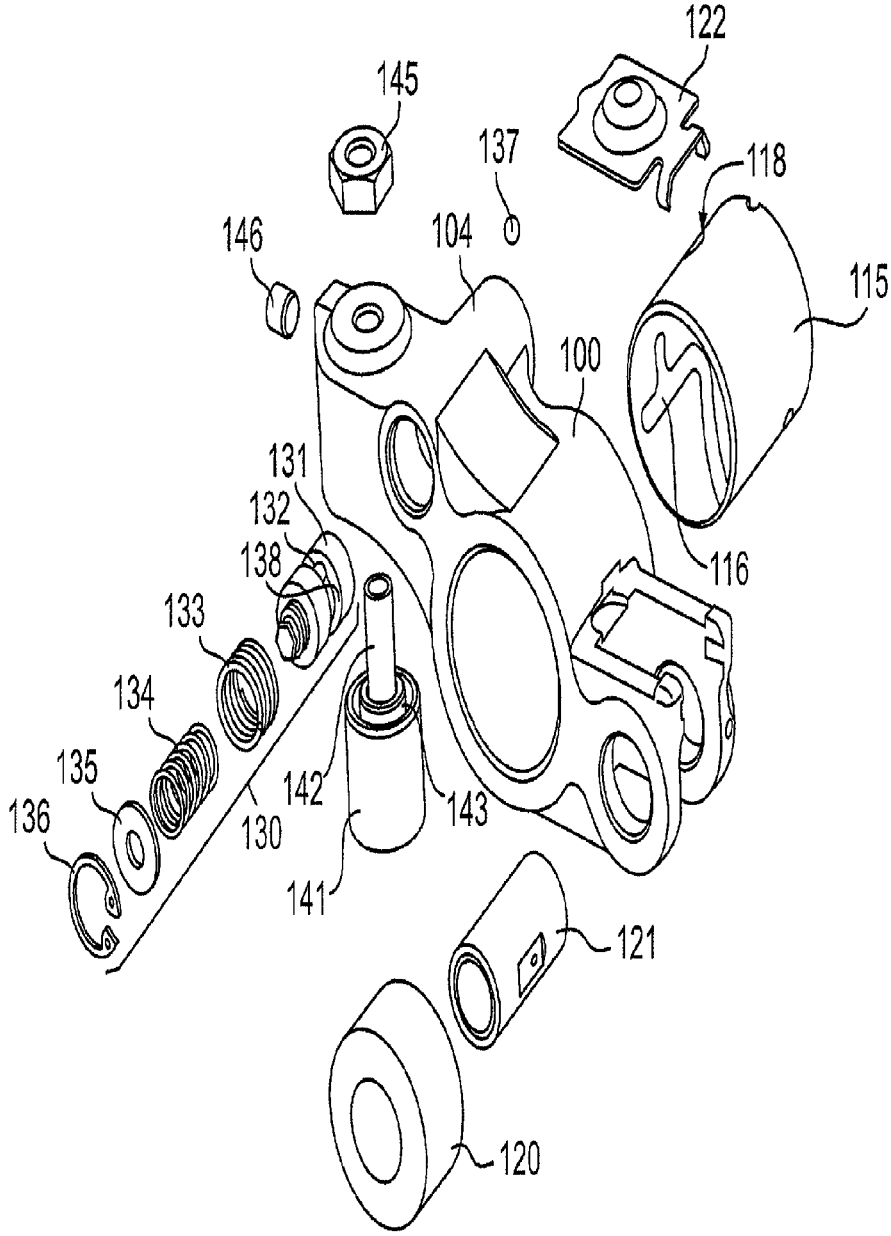
FIG. 6 is an exploded pictorial view of the rocker arm 100 shown in FIG. 1.
Figure 7:
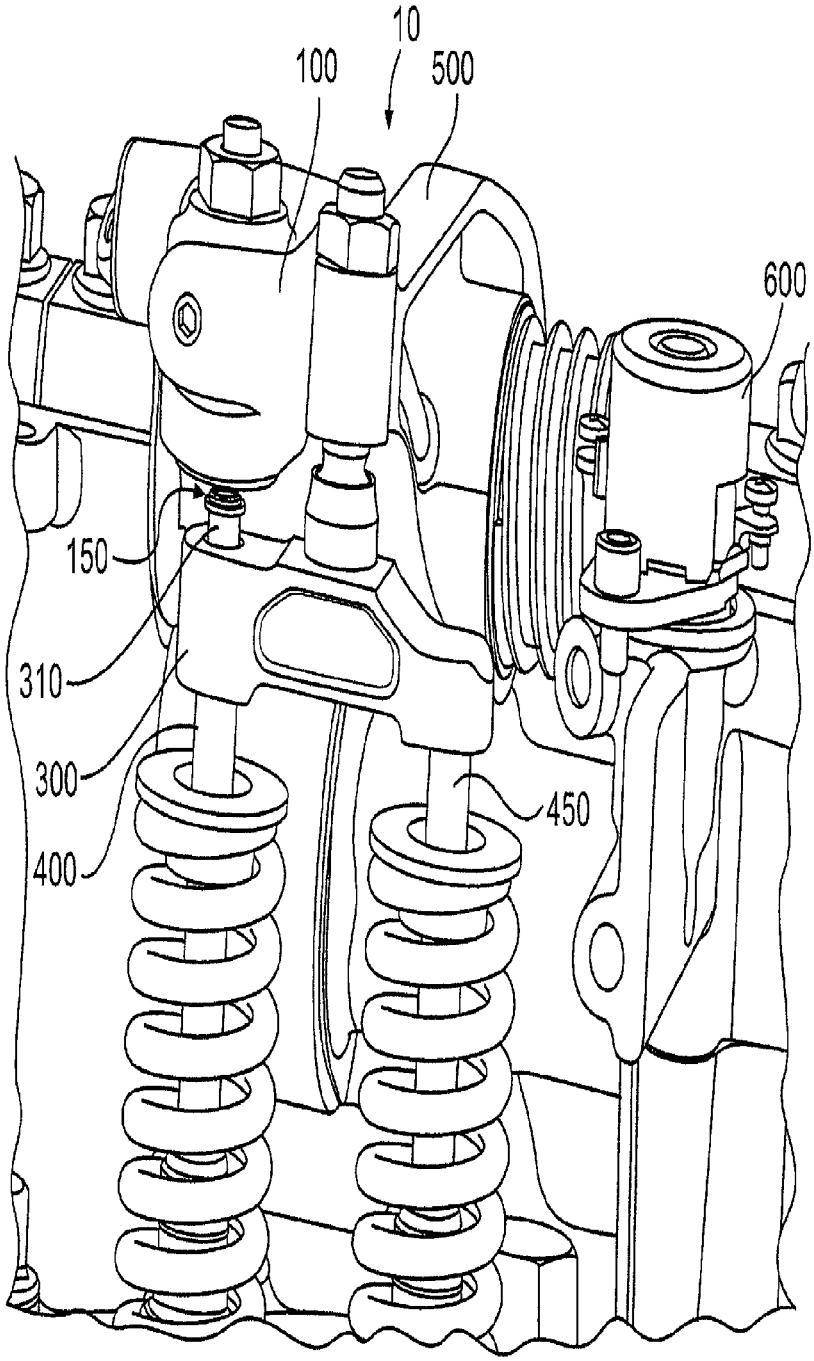
FIG. 7 is a front pictorial view of the rocker arm 100 shown in FIG. 1 and an adjacent main exhaust rocker arm 500.
Figure 8:
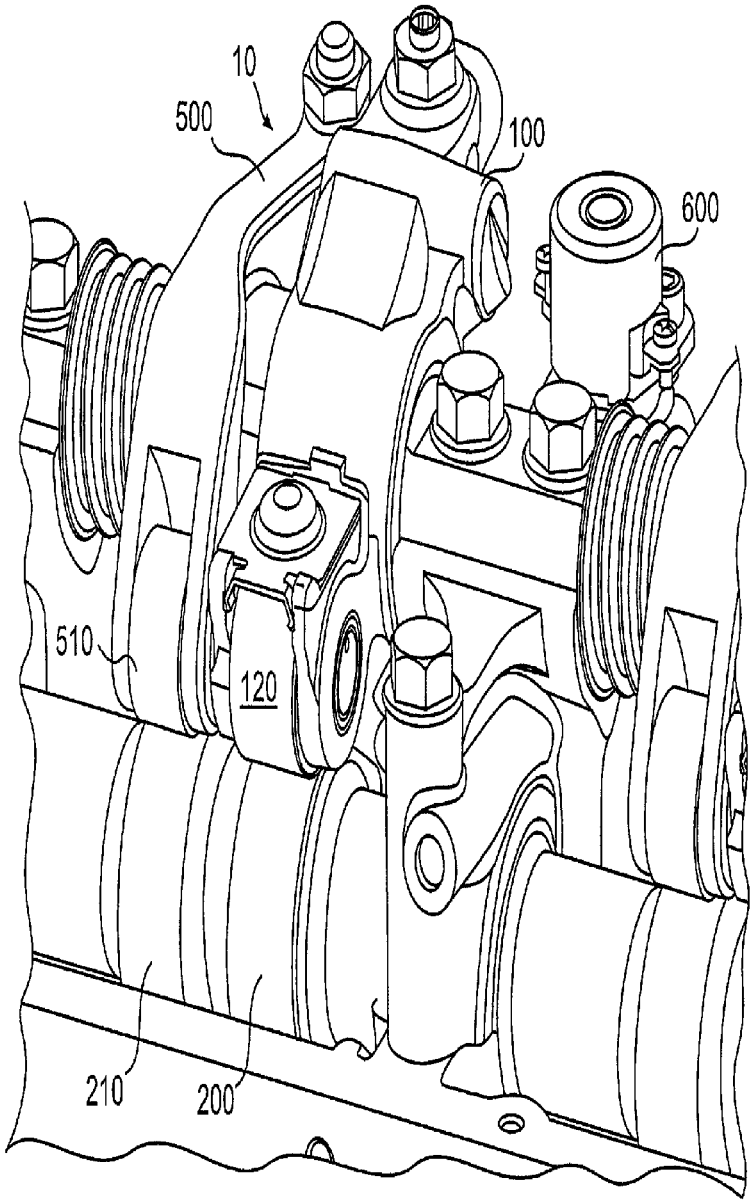
FIG. 8 is a rear pictorial view of the rocker arm 100 and main exhaust rocker arm 500 shown in FIG. 7.

With reference to FIGS. 5 and 6, the engine braking rocker arm 100 includes a rocker shaft bore extending laterally through a central portion of it for receiving a bushing 115. The bushing 115 may be adapted to receive the rocker arm shaft 110. The bushing 115 may include one or more slots 116 and ports 118 formed in the wall thereof to receive fluid from the fluid passages formed in the rocker arm shaft 110. The port 118 may register with a mating hydraulic passage 102 provided in the engine braking rocker arm.

The engine braking rocker arm 100 may include one or more internal passages for the delivery of hydraulic fluid through it, which fluid is received from the port 118. With renewed reference to FIGS. 1-4 and 7-8, the internal passages in the engine braking rocker arm 100 may permit hydraulic fluid, such as engine oil, to be provided to the control valve 130 and the actuator piston assembly 140. The hydraulic fluid may be selectively supplied to the control valve 130 and the actuator piston 140 under the control of a solenoid valve 600, or other electrically controlled valve which is shown in FIGS. 5 and 6. The solenoid valve 600 may be mounted on the cam cap and hydraulic passages may be provided within the engine head and/or cam cap to provide hydraulic fluid to the control fluid supply passage 112 in the rocker arm shaft 110. Hydraulic fluid may be selectively supplied to the passage 112 by opening and closing the solenoid valve 600. One solenoid valve 600 may service multiple valve actuation systems 10 provided with the engine.

The engine braking rocker arm 100 includes a valve actuation end having an actuator piston assembly 140. The actuator piston assembly may include a slide-able actuator piston 141 disposed in a bore provided in the engine braking rocker arm. The actuator piston 141 may have a hollow interior for slideably receiving the bottom end of a lash adjustment screw 142. The upper portion of the hollow interior of the actuator piston 141 may have a collar 143 which is fixed into a position with a retaining washer in the actuator piston. A spring 144 may be provided between the collar 143 and an enlarged portion of the bottom end of the lash adjustment screw 142. The spring 144 may bias the actuator piston 141 upward, away from the sliding pin 310, by acting on the actuator piston through the collar 143. The lash adjustment screw 142 may protrude from the top of the engine braking rocker arm 100 and permit adjustment of the lash space 150 between the bottom surface of the actuator piston 141 and the sliding pin 310. The lash adjustment screw 142 may be locked in place by a nut 145.

With reference to FIGS. 5 and 6, the engine braking rocker arm 100 may include a control valve boss 104. A control valve 130 may be disposed in a bore formed in the control valve boss 104. The control valve 130 may control the supply of hydraulic fluid to the actuator piston assembly 140. A hydraulic passage 102 may connect the control valve boss 104 to the port 118 in the bushing 115. The passage 102 may be sealed at an outer surface of the rocker arm 100 by a plug 137.

FIG. 6 shows the detail of the control valve 130. The control valve 130 may include a control valve piston 131 which is a generally cylindrically shaped element with one or more internal passages 132, and which may incorporate an internal control check valve (not shown). The check valve may permit fluid to pass from the hydraulic passage 102 through the center of the control valve piston 131 and out of the internal passage 132 through a fluid passage 105 in the engine braking rocker arm 100 to the actuator piston assembly 140, but not in the reverse direction. The control valve piston 131 may be spring biased by one or more control valve springs 133 and 134 into the control valve bore toward the internal passage 102. The control valve springs 133 and 134 may be retained in place by a washer 135 and C-ring 136. A central internal passage may extend axially from the inner end of the control valve piston 131 towards the middle of the control valve piston where the control check valve may be located. The central internal passage in the control valve piston 131 may communicate with one or more passages 132 extending across the diameter of the control valve piston 131 to an annular recess 138. As a result of translation of the control valve piston 131 relative to its bore when fluid is provided in hydraulic passage 102, the passages 132 extending through the control valve piston 131 may selectively register with a port that connects the side wall of the control valve bore with the fluid passage 105 extending to the actuator piston assembly 140. When the passages extending through the control valve piston 131 register with the fluid passage 105, low pressure fluid may flow from the hydraulic passage 102, through the control valve piston 131, and into the actuator piston assembly 140. The outer end of the fluid passage 105 may be sealed by a plug 146.

Operation in accordance with a first method embodiment of the present invention, using the system 10 for actuating engine valves shown in FIGS. 1-8, will now be explained. With reference to FIGS. 1-8, engine operation causes the cam 210 to rotate. The rotation of the cam 210 causes the exhaust rocker arm 500 to pivot about the rocker shaft 110 and actuate the exhaust valves 400 and 410 for main exhaust events in response to interaction between the main exhaust lobe on the cam 210 and the exhaust cam roller 510. Likewise, the upper base circle portion 202 on the cam 200 may cause the engine braking rocker arm 100 to pivot about the rocker shaft 110.

Figure 3:
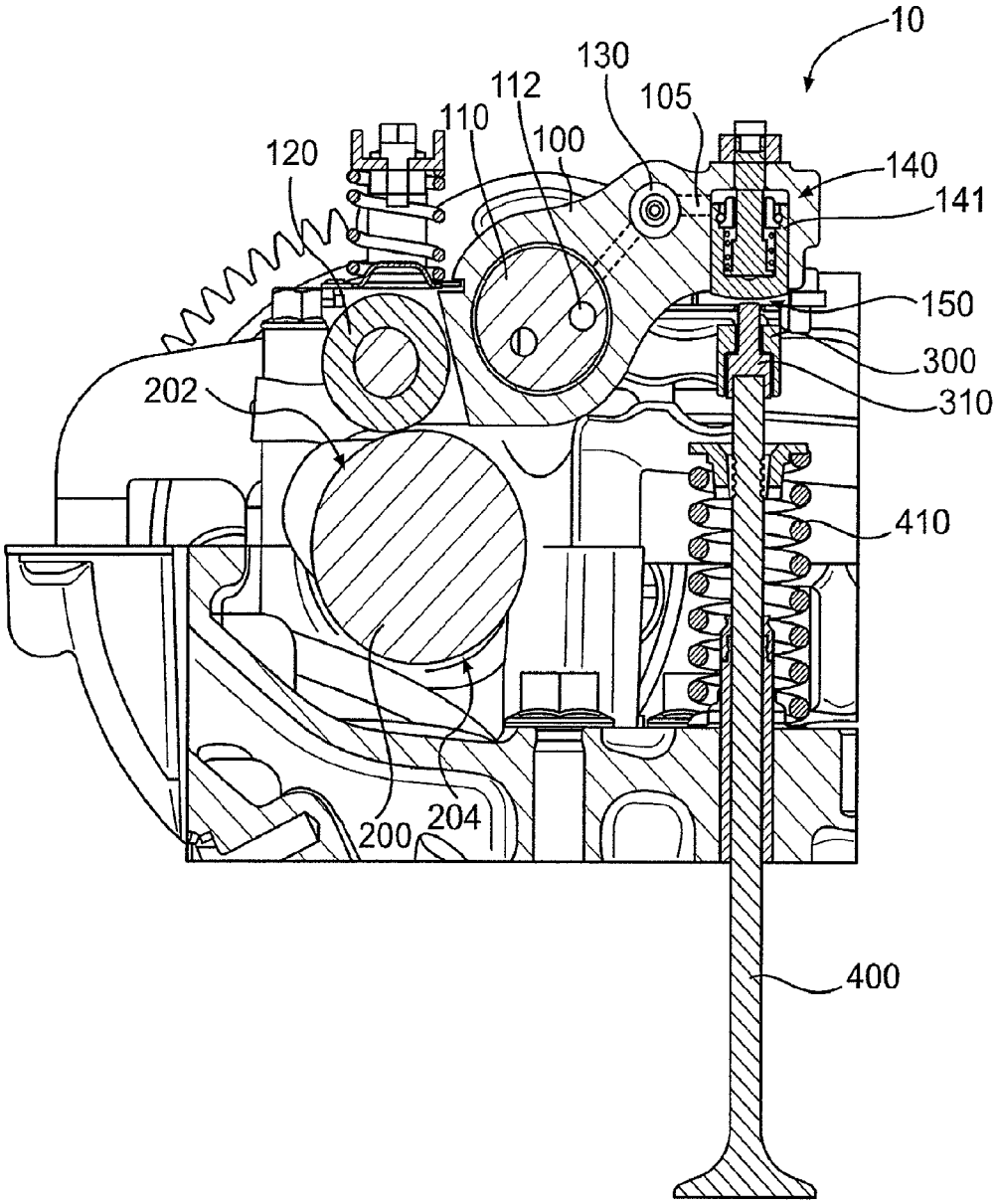
FIG. 3 is a side view in cross-section of the rocker arm 100 shown in FIG. 1 when the brake is off and the cam roller 120 is on the upper base circle of the cam 200.
Figure 4:
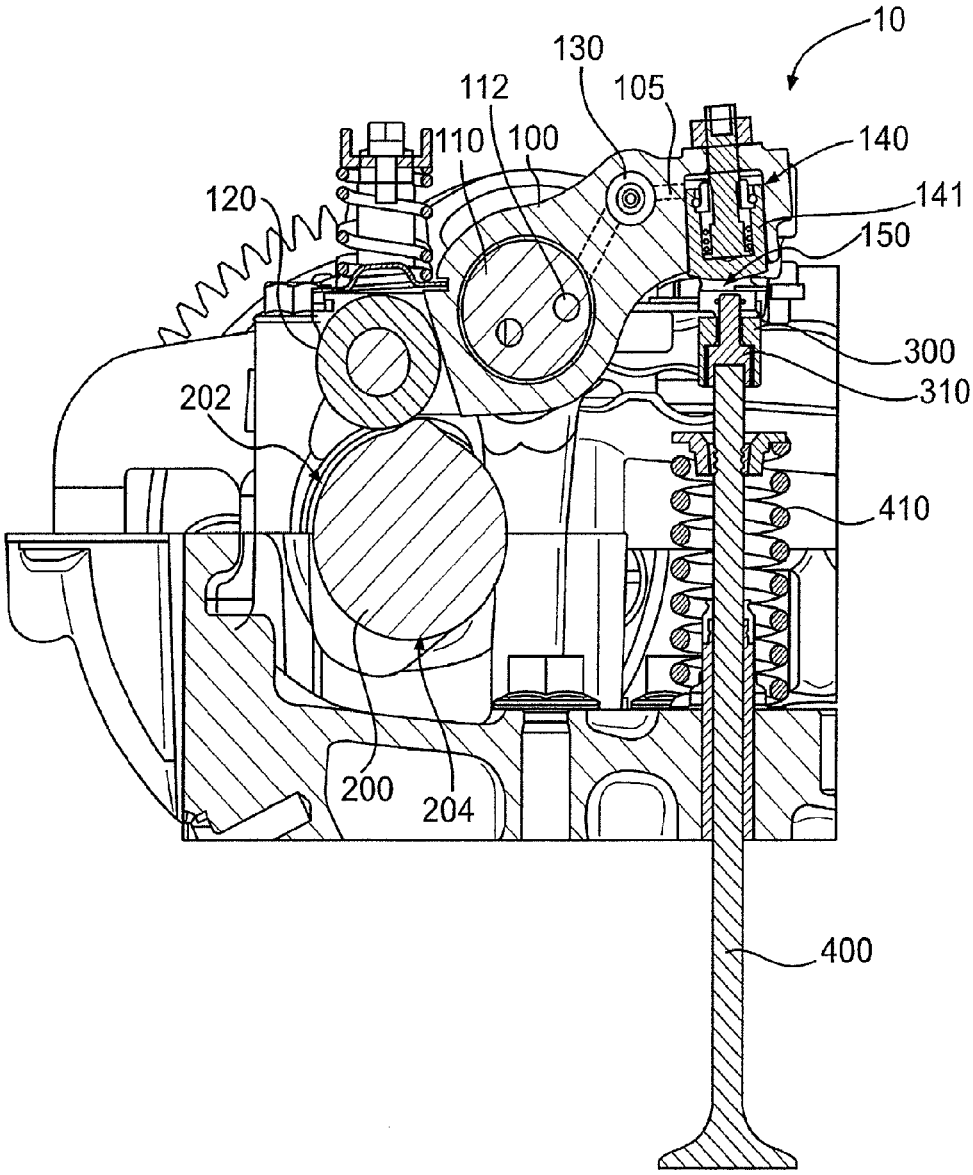
FIG. 4 is a side view in cross-section of the rocker arm 100 shown in FIG. 1 when the brake is off and the cam roller 120 is on the lower base circle of the cam 200.

FIGS. 3 and 4 show the system 10 during positive power (non-engine braking) operation of the engine. During positive power operation of the system, the solenoid 600 may be operated so as not to continually supply low pressure hydraulic fluid to the control fluid supply passage 112. As a result, hydraulic fluid pressure in the hydraulic passage 102 is insufficient to overcome the bias of the control valve springs 133 and 134. In turn, the springs 133 and 134 hold the control valve piston 131 in a position that prevents the supply of hydraulic fluid to the actuator piston assembly 140, and instead permits the release of hydraulic fluid pressure from the actuator piston assembly. The absence of any appreciable hydraulic fluid pressure in the actuator piston assembly 140 permits the spring 144 to push the actuator piston 141 into its upper most position (shown in FIGS. 3 and 4), creating a lash space 150 between the actuator piston and the sliding pin 310. The lash space 150 is sufficiently great to exist between the actuator piston 141 and the sliding pin 310 both when the cam roller 120 is in contact with the upper base circle portion 202 of the cam 200 (shown in FIG. 3) and when the cam roller is in contact with the lower base circle portion 204 of the cam (shown in FIG. 4). Accordingly, throughout the rotation of the cam 200 during positive power operation of the engine, the actuator piston 141 does not make contact with the sliding pin 310, and the exhaust valve 400 is not actuated for engine braking.

Figure 2:
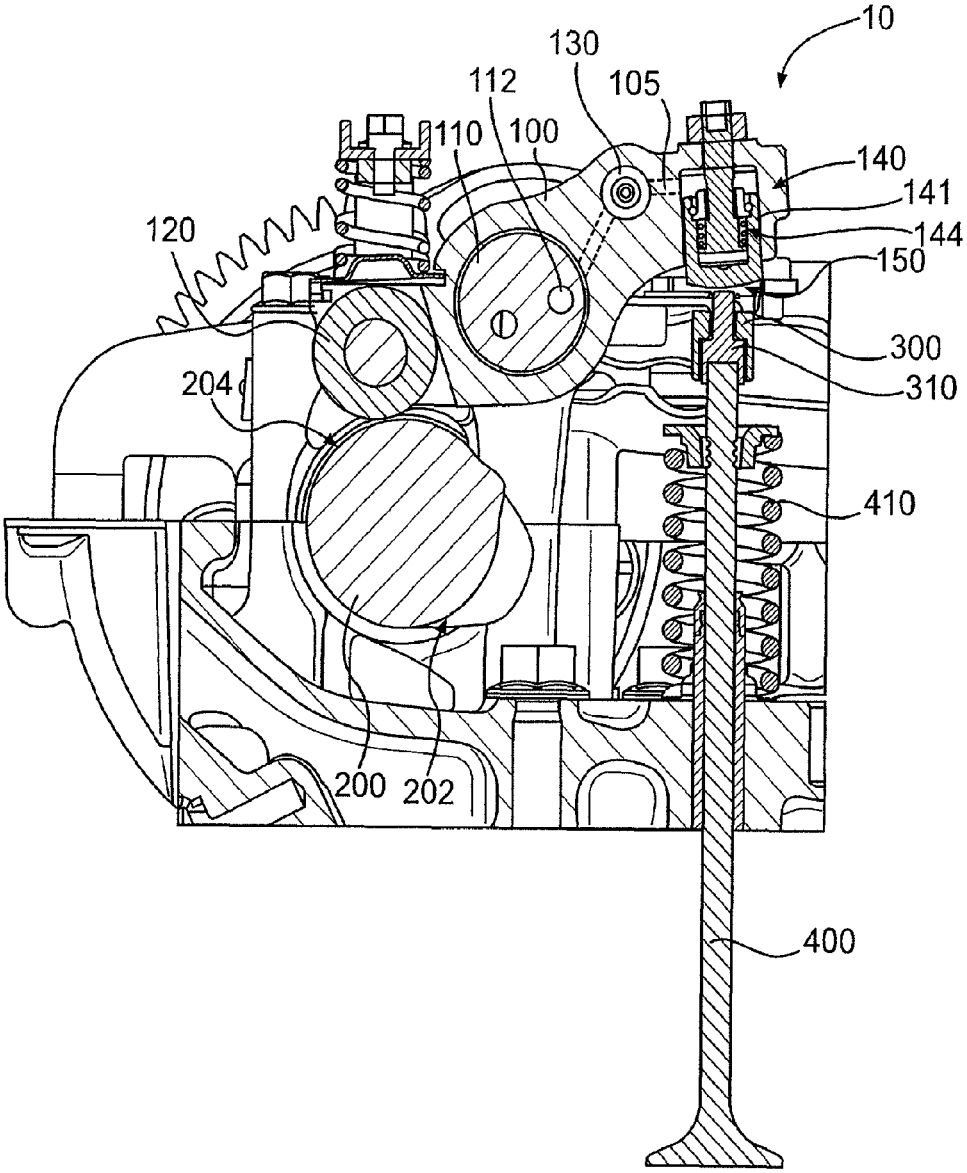
FIG. 2 is a side view in cross-section of the rocker arm 100 shown in FIG. 1 when the brake is on and the cam roller 120 is on the lower base circle of the cam 200.

FIGS. 1 and 2 show the system 10 during engine braking operation. When exhaust valve actuation is desired for engine braking (or EGR, and/or BGR), the fluid pressure in the control fluid supply passage 112 may be increased. The solenoid valve 600 may be used to control the application of increased fluid pressure in the control fluid supply passage 112. Increased fluid pressure in the control fluid supply passage 112 is applied through the hydraulic passage 102 to the control valve piston 131. As a result, the control valve piston 131 may be displaced in the control valve bore into an "engine brake on" position against the bias of the springs 133 and 134. When this occurs, the control valve piston 131 moves so that its internal fluid passages 132 register with the fluid passage 105. The check valve within the control valve piston may prevent fluid that enters the fluid passage 105 from flowing back through the control valve piston 131. Fluid pressure in the fluid passage 105 may be sufficient to overcome the bias force of the spring 144 in the actuator piston assembly 140. As a result, the actuator piston assembly 140 may fill with hydraulic fluid, and the actuator piston 141 may extend downward, out of its bore, thereby reducing the lash space 150 between the actuator piston and the sliding pin 310. As long as low pressure fluid maintains the control valve piston 131 in the "engine brake on" position, the actuator piston 141 may be hydraulically locked into this extended position.

Thereafter, pivoting of the engine braking rocker arm 100 caused by the upper base circle portion 202 of the cam 200 pushing the cam roller 120 upward may produce an engine braking valve actuation corresponding to the shape and size of the upper base circle portion. The engine braking event occurs because the upper base circle portion 202 of the cam 200 pivots the engine braking rocker arm 100 clockwise, which causes the actuator piston (in its extended position) to push the sliding pin 310 downward, which in turn pushes the exhaust valve 400 open (as shown in FIG. 1). When the cam 200 rotates so that the lower base circle portion 204 is in contact with the cam roller 120, a small lash space 150 develops between the actuator piston 141 and the sliding pin 310, which permits the exhaust valve 400 to close (as shown in FIG. 2).

When engine braking valve actuation is no longer desired, pressure in the control fluid supply passage 112 may be reduced or vented, and the control valve piston 131 will return to an "engine brake off" position. Fluid in the actuator piston assembly 140 may then vent back through the fluid passage 105 and out of the control valve 130. The system 10 then returns to positive power operation.

It will be apparent to those skilled in the art that variations and modifications of the present invention can be made without departing from the scope or spirit of the invention. For example, it is appreciated that the exhaust rocker arm 500 could be implemented as an intake rocker arm, and the engine braking rocker arm 100 could be used to provide auxiliary intake valve actuations, without departing from the intended scope of the invention. Furthermore, various embodiments of the invention may or may not include a means for biasing the engine braking rocker arm 100 and the biasing means may be implemented using different spring orientations. These and other modifications to the above-described embodiments of the invention may be made without departing from the intended scope of the invention.

What is claimed is:

1. A system for actuating an engine exhaust valve for engine braking comprising:

a rocker arm shaft (110) having a control fluid supply passage (112);

an engine braking rocker arm (100) pivotally mounted on the rocker arm shaft (110), said engine braking rocker arm having a central opening disposed about the rocker arm shaft (110), a hydraulic passage (102) connecting the central opening with a control valve (130), and a fluid passage (105) connecting the control valve with an actuator piston assembly (140);

a valve bridge (300) extending between first and second engine exhaust valves (400, 450);

a sliding pin (310) provided in the valve bridge (300), said sliding pin contacting the first engine exhaust valve (400), wherein the actuator piston assembly (140) contacts the sliding pin (310);

a cam (200) for imparting engine braking actuation to the engine braking rocker arm (100); and a spring (124) biasing the engine braking rocker arm (100) into contact with the cam (200).

2. The system of claim 1, further comprising:

an exhaust rocker arm (500) pivotally mounted on the rocker arm shaft (110) adjacent to the engine braking rocker arm (100); and a cam (210) for imparting main exhaust valve actuation to the exhaust rocker arm (500).

3. The system of claim 2, further comprising:

a plate (122) fastened to a back end of the engine braking rocker arm (100), said plate including a central raised portion (123) which receives an end of the spring (124), a front tab (125) and two side tabs (127), said tabs (125, 127) engaging mating slots in the engine braking rocker arm (100).

4. The system of claim 3, further comprising:

a bushing (115) disposed between the engine braking rocker arm (100) and the rocker arm shaft (110), said bushing having a slot (116), and a port (118) which registers with the hydraulic passage (102).

5. The system of claim 4, wherein the actuator piston assembly comprises:

a slide-able actuator piston (141) disposed in a bore provided in the engine braking rocker arm, said actuator piston having a hollow interior;

a lash adjustment screw (142) extending through the engine braking rocker arm (100) into the hollow interior of the actuator piston (141), said lash adjustment screw having an enlarged portion at a bottom end;

a collar (143) fixed in an upper portion of the hollow interior of the actuator piston (141); and a spring (144) provided between the collar (143) and the enlarged portion of the bottom end of the lash adjustment screw (142).

6. The system of claim 5, wherein the control valve comprises:

a control valve piston (131) having an internal passage (132); and a spring (133, 134) biasing the control valve piston (131) into the engine braking rocker arm (100).

7. The system of claim 6, wherein the sliding pin (310) comprises a shoulder at a mid-portion, and the valve bridge (300) comprises a bore with a mating shoulder for the sliding pin shoulder.

8. The system of claim 1, further comprising:

a plate (122) fastened to a back end of the engine braking rocker arm (100), said plate including a central raised portion (123) which receives an end of the spring (124), a front tab (125) and two side tabs (127), said tabs (125, 127) engaging mating slots in the engine braking rocker arm (100).

9. The system of claim 1, further comprising:

a bushing (115) disposed between the engine braking rocker arm (100) and the rocker arm shaft (110), said bushing having a slot (116), and a port (118) which registers with the hydraulic passage (102).

10. The system of claim 1, wherein the actuator piston assembly comprises:

a slide-able actuator piston (141) disposed in a bore provided in the engine braking rocker arm, said actuator piston having a hollow interior;

a lash adjustment screw (142) extending through the engine braking rocker arm (100) into the hollow interior of the actuator piston (141), said lash adjustment screw having an enlarged portion at a bottom end;

a collar (143) fixed in an upper portion of the hollow interior of the actuator piston (141); and a spring (144) provided between the collar (143) and the enlarged portion of the bottom end of the lash adjustment screw (142).

11. The system of claim 1, wherein the control valve comprises:

a control valve piston (131) having an internal passage (132); and a spring (133, 134) biasing the control valve piston (131) into the engine braking rocker arm (100).

12. The system of claim 1, wherein the sliding pin (310) comprises a shoulder at a mid-portion, and the valve bridge (300) comprises a bore with a mating shoulder for the sliding pin shoulder.

13. A system for actuating an engine valve comprising:

a rocker arm shaft (110) having a control fluid supply passage (112);

an exhaust rocker arm (500) pivotally mounted on the rocker arm shaft (110);

a cam (210) for imparting main exhaust valve actuation to the exhaust rocker arm (500);

a valve bridge (300) disposed between the exhaust rocker arm (500) and first and second engine valves (400, 450);

a sliding pin (310) provided in the valve bridge (300), said sliding pin contacting the first engine valve (400);

an engine braking rocker arm (100) pivotally mounted on the rocker arm shaft (110) adjacent to the exhaust rocker arm (500), said engine braking rocker arm having a central opening, a hydraulic passage (102) connecting the central opening with a control valve (130), and a fluid passage (105) connecting the control valve with an actuator piston assembly (140), wherein the actuator piston assembly includes an actuator piston (141) adapted to contact the sliding pin (310);

a bushing (115) disposed between the engine braking rocker arm (100) and the rocker arm shaft (110), said bushing having a port (118) which registers with the hydraulic passage (102);

a cam (200) for imparting engine braking actuation to the engine braking rocker arm (100);

a plate (122) fastened to a back end of the engine braking rocker arm (100); and a spring (124) contacting the plate (122) and biasing the engine braking rocker arm (100) into contact with the cam (200).

* * * * *